US006629499B1

(12) United States Patent
Greene et al.

(10) Patent No.: US 6,629,499 B1
(45) Date of Patent: Oct. 7, 2003

(54) TEMPERATURE ACTIVATED MECHANICAL TIMER

(75) Inventors: Michael L. Greene, Fort Washington, MD (US); David R Keene, Woodbridge, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/095,147

(22) Filed: Mar. 12, 2002

(51) Int. Cl.[7] ..... F42C 0/00
(52) U.S. Cl. ..... 102/426; 102/402; 102/276
(58) Field of Search ..... 102/426, 402, 102/276

(56) References Cited

U.S. PATENT DOCUMENTS 1,469,552 A * 10/1923 Burdette ..... 235/91 R
2,487,789 A * 11/1949 Carr et al. ..... 102/257
2,625,104 A * 1/1953 Bugg ..... 102/326
3,702,589 A * 11/1972 Erbert ..... 102/272
3,858,516 A * 1/1975 Rabinow ..... 102/216
4,303,195 A 12/1981 Hashimoto et al. ..... 236/48
4,328,752 A * 5/1982 Jander ..... 102/257
4,507,642 A 3/1985 Blackburn ..... 337/89
4,679,943 A 7/1987 Kavoussi et al. ..... 368/12
4,914,415 A * 4/1990 Cambien ..... 337/379
4,970,485 A 11/1990 Wahls ..... 337/335
5,043,690 A 8/1991 Wahls ..... 337/370
5,148,826 A 9/1992 Bakhshaei ..... 137/80
5,452,335 A * 9/1995 Slater et al. ..... 377/25
6,039,262 A 3/2000 DeAnna ..... 236/93
6,363,854 B1 * 4/2002 Schweitzer ..... 102/401

* cited by examiner

*Primary Examiner*—Michael J. Carone
*Assistant Examiner*—M. Thomson
(74) *Attorney, Agent, or Firm*—Mark Homer

(57) ABSTRACT

The present invention comprises a mechanical timer that operates by using the ambient temperature differences during daytime and nighttime periods in order to count desired intervals of days, months, etc. Embodiments of the invention employ the timer to render safe land mines or other ordnance devices after a specified period of time. Because the present invention uses ambient temperature differences in order to operate, no outside power source is required.

10 Claims, 3 Drawing Sheets

TEMPERATURE ACTIVATED MECHANICAL TIMER

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to mechanical timer devices that depend upon ambient temperature fluctuations to count down, more particularly to such devices that provide actuation after a certain period of time, and most particularly to such devices used to render safe a mine or other ordnance device after a certain period of time.

2. Description of the Related Art

The need for mines or other ordnance devices placed or buried upon land to be rendered safe or self-destruct after a certain period of time is of great importance to the military. After specific military missions or actions have been completed, it is often important to neutralize or deactivate such mines in order to ensure that civilian personnel or one's own military personnel are not harmed by mines that have not been activated by enemy forces. Because it is inherently unsafe to attempt to neutralize or deactivate such mines, efforts have been made to develop a method whereby the mines would self-destruct or deactivate after a certain period of time has elapsed. However, there are problems associated with placing a standard timer and actuator system within the mines. Most importantly, any standard timer would require power to operate. This could be potentially unsafe and allow such mines to be more easily detected. Therefore, the development of a timer and actuator system requiring no external power is necessary to accomplish this goal.

Many actuators using bimetallic materials have been developed. Many of them apply snap-action, bimetallic disks in order to provide actuation after a certain temperature threshold has been reached. Examples of such actuators include U.S. Pat. Nos. 4,507,642; 5,043,690; and 6,039,262. These patents are hereby incorporated by reference. These actuators were developed to provide one discreet actuation, for example opening or closing an electrical circuit, when a certain temperature has been reached. Several applications of this technology have been developed wherein the properties inherent in the bimetallic materials are used to provide actuation when a certain threshold temperature has been reached and to provide deactuation when the temperature falls below this threshold. Examples of such applications include U.S. Pat. Nos. 4,303,195; 4,679,943; and 5,148,826. In these patents, the bimetallic disk technology was used to open and close valves or deliver water or scented oil after certain threshold temperatures had been reached. However, none of the these disclosures attempt to use the bimetallic material technology in order to provide a timer that can be adjusted to monitor specific time frames based upon changes in ambient temperature.

Therefore, it is desired to produce a mechanical timer, that uses no external power source, based upon changes in ambient temperature in order to deactivate mines or other ordnance devices after a specified period of time.

SUMMARY OF THE INVENTION

The present invention comprises a mechanical timer that operates by using the ambient temperature differences during daytime and nighttime periods in order to count desired intervals of days, months, etc. Embodiments of the invention employ the timer to render safe land mines or other ordnance devices after a specified period of time. Because the present invention uses ambient temperature differences in order to operate, no outside power source is required.

Accordingly, it is an object of this invention to provide a mechanical timer that requires no external power source.

It is a further object of this invention to provide a mechanical timer that operates using ambient temperature differentials.

It is yet a further object of this invention to provide a mechanical timer that renders safe land mines or other ordnance devices after a specified time period.

This invention accomplishes these objectives and other needs related to mechanical timers that operate using changes in ambient temperature by providing a mechanical, temperature activated timer, comprising a housing with at least one member. The member is moveably attached to the housing. The member also has a plurality of serrations arranged unidirectionally along one or more sides of the member. First and second pawls that are attached to the housing cooperate with the serrations of the member to allow movement of the member in relationship to the housing in one direction only. At least one bimetallic material is placed within the housing. The bimetallic material has a first shape below its transition temperature and a second shape above its transition temperature. When the bimetallic material changes its shape due to reaching its transition temperature, the second pawl will transverse a serration on the member and move closer to the first pawl. The pawls are placed unidirectionally to cooperate with one another so that bringing the bimetallic material back to its original shape results in motion of the member. Therefore, if one uses temperature data for a specific location, a bimetallic material may be selected that has a transition temperature within the normal range between daytime and nighttime temperatures. Using this data, one can use the present invention in order to count days through the movement of the member wherein each serration comprises one transition cycle of the bimetallic material, or one day.

One specific preferred embodiment of this invention is used in order to render safe land mines by moving a safety pin or other blocking device between the trigger and firing pin of the mine through the movement of the member of the timer as described above.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises a mechanical timer that uses changes in the ambient temperature to count specific time intervals. In general, the invention comprises a housing with at least one member. The member is moveably attached to the housing. The member also has a plurality of serrations arranged unidirectionally along one or more sides of the member. At least one bimetallic material is placed within the housing. The bimetallic material has a first shape below its transition temperature and a second shape above its transition temperature. First and second pawls are attached to the housing and cooperate with one another to move across the serrations along the member. When the bimetallic material changes its shape due to reaching its transition temperature, the second pawl will transverse one serration of the member. The pawls are placed unidirectionally so that bringing the bimetallic material back to its original shape does not cause the member to return to its original position, but instead forces the member to physically change position. Therefore, when the bimetallic material returns to its original shape, the member will complete its movement of one serration.

The present invention can be tailored to operate in different locations dependent upon the climates of the locations. Weather data can be obtained to determine the normal temperature differentials during particular times of the year between daytime and nighttime and this data can be used to select an appropriate bimetallic material. The present invention operates particularly well in climates such as deserts due to the large variation in temperature between the daytime and the nighttime.

One preferred use for the mechanical timer of the present invention is coupling it within a land mine or other ordnance device in order to render the mine safe after a specified interval of time. Depending upon the climate wherein the mine will be deployed, one could select a preferred bimetallic material and place the timer within the mine so that the member itself or something attached to the member moves into the space between the trigger and the firing pin within the mine. In operation, the member would move one serration during each cycle of the bimetallic material between its temperature dependent shapes. The timer can be designed with any number of serrations so that it will move the requisite distance over the selected number of days in order to move the member into position to render the mine safe.

Figure 1:
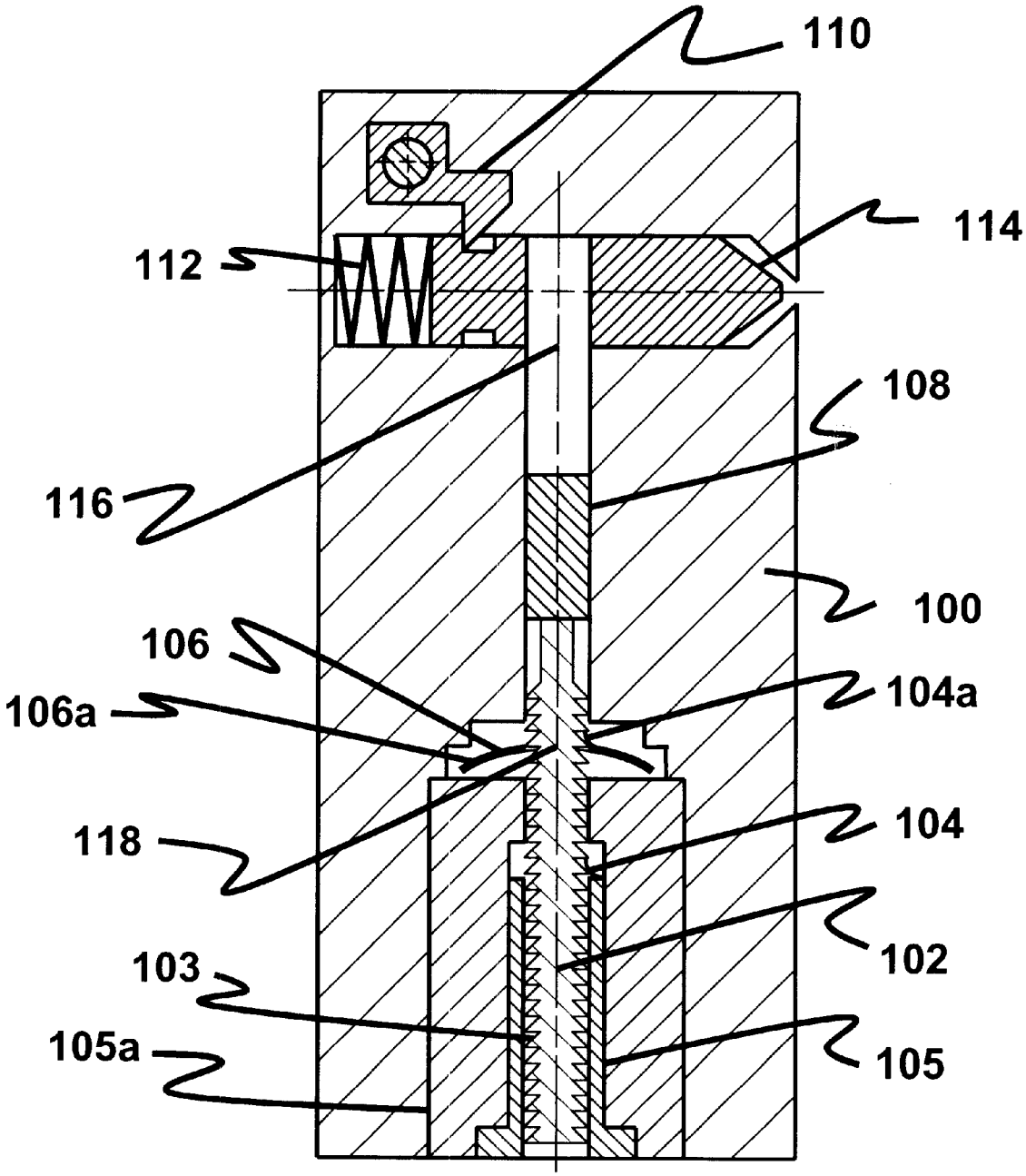
FIG. 1 is an embodiment of the invention with one bimetallic member.

Referring to FIG. 1, the mechanical, temperature activated timer comprises a housing 100, having a cylindrical rod member 102 moveably attached to the housing 100. The member 102 has unidirectional serrations 103 arranged uniformly along its periphery. The serrations 103 can be arranged along one or multiple sides along the periphery of the member 102. First and second pawls 104, 104*a* are attached the housing 100 to traverse member 102 in one direction only with respect to the member 102. The first pawl 104 is attached to cylindrical insert 105 that is contained within cylindrical insert 105*a*. The second pawl 104*a* is attached to the bimetallic material 106 that is placed within the housing. The bimetallic material 106 maintains a first shape 106*a* below its transition temperature and a second shape (see 106*b* in FIG. 2) above its A transition temperature. The bimetallic material 106 is placed so that the change from the first shape 106*a* to the second shape 106*b* causes the attached second pawl 104*a* to transverse one serration 103 of member 102. Because the pawls 104 are unidirectional, the change from the second shape 106*b* back to the first shape 106*a* does not force the member 102 back in the opposite direction. Therefore, because of the ratcheting action of each pawl, 104, 104*a*, the subsequent movement by the member represents one transition cycle between daytime and nighttime temperatures, one can count the number of days by the number of serrations 104 that have been traversed.

The mechanical timer of the present invention can also be designed to provide actuation after a certain time period has elapsed. One preferred embodiment of the invention comprises rendering safe a land mine or other ordnance device. Referring again to FIG. 1, the invention may also comprise an actuation member 108, attached to an end of the member 102, so the actuation member 108 provides actuation after the member 102 moves a specified distance. This actuation member 108 can be used in order to render safe a land mine as depicted in FIG. 1. The trigger 110 can be released so that a release spring 112 initiates the firing pin 114 to activate the mine. The present invention uses the actuation member 108 as a safety pin by moving it into the space 116 between the trigger 110 and the firing pin 114 so that the mine is rendered safe.

In the embodiment of the invention in FIG. 1, the bimetallic material 106, and attached second pawl 104*a*, is in contact with the member 102 through an aperture 118. The area of the aperture 118 is such that the portion of the member 102 with the serrations 103 may slide through the aperture 118 due to the downward transitioning temperature motion of the bimetallic material 106. This would only occur when force caused by the transition in shapes of the bimetallic material 106 occur. The first pawl 104 will prevent motion of member 102 during the ratcheting of the second pawl 104*a* due to the locked ratchet position of the first pawl 104. When the bimetallic material 106 returns to its original shape, the second pawl 104*a* is in the locked ratchet position and moves the member 102 upward with the first pawl 104 now ratcheting and allowing member 102 to pass.

Regarding the housing 100 and the member 102, almost any material may be used for their construction and may be selected by one skilled in the art. The exact shape of and distance between the pawls 104 may be selected by one skilled in the art depending upon the number and type of bimetallic material 106 used. One example of a member 102 with serrations 103 that could be employed in the present invention would be plastic wire ties used to harness items in the building and electronics industry. The bimetallic material 106 itself may be selected by one skilled in the art. Bimetallic materials are fabricated from two layers of metal such as Invar (an alloy of iron, nickel, carbon, manganese, and silicon that has a low coefficient of expansion) and steel having different coefficients of expansion. However, the bimetallic, snap-action disks may be fabricated from other materials having different temperature coefficients, whether metallic or non-metallic, and the term bimetallic is intended to encompass any structure utilizing materials of different temperature coefficient as a thermal actuator. One preferred bimetallic material are bimetallic, snap-action disks disclosed in the prior art referenced above.

Figure 2:
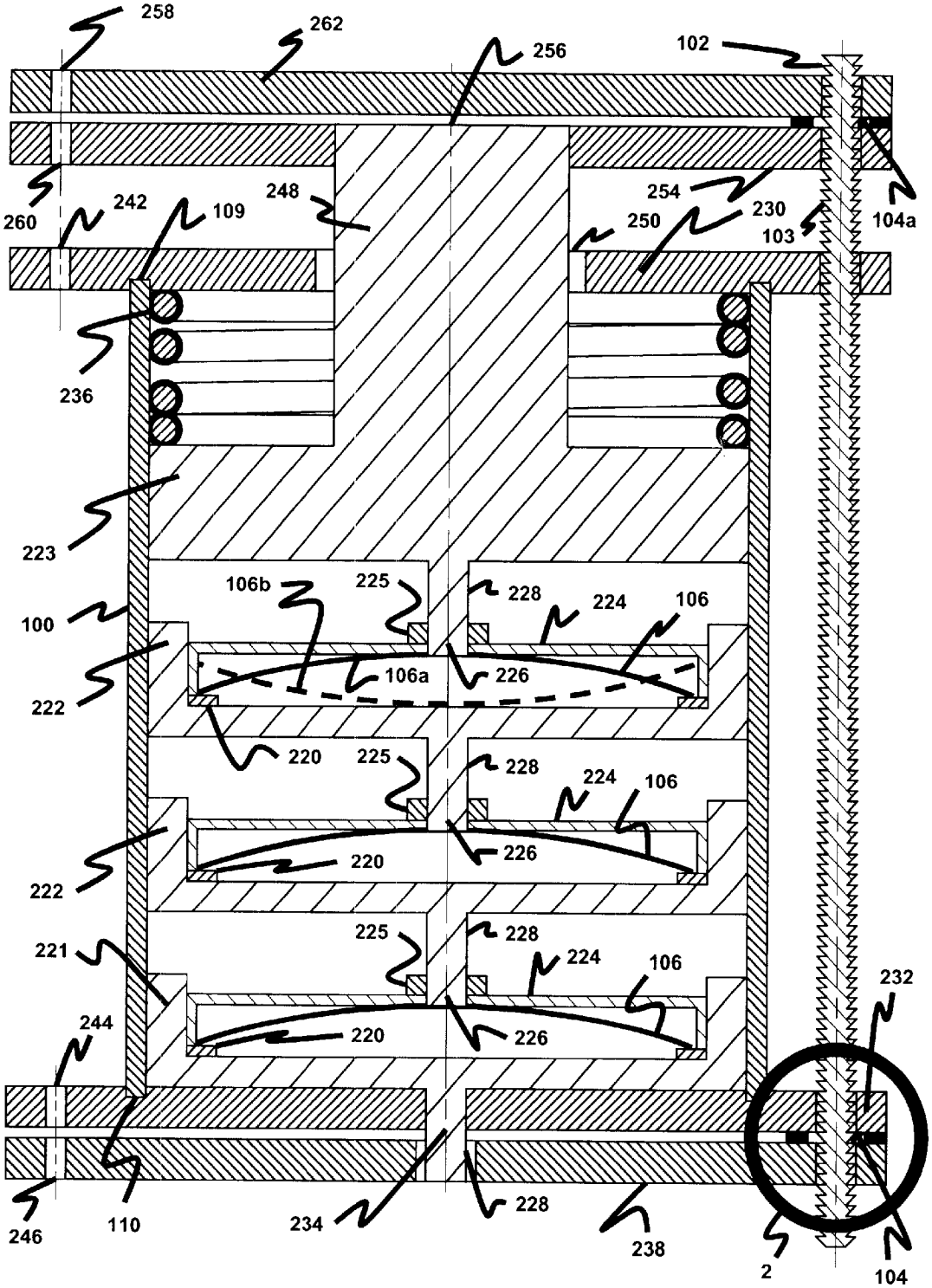
FIG. 2 is an embodiment of the invention with three bimetallic members.

A general embodiment of the invention being discussed above, FIG. 2 depicts a second embodiment of the invention that may be fabricated using only parts that are readily available from commercial sources. Referring to FIG. 2, a plurality of bimetallic, snap-action disks 106 are used. Each bimetallic, snap-action disk 106 rests on a washer 220 that is centrally disposed about the center line of the device and held in position by a sliding member 221, 222. For each snap-action disk 106, cylindrical cap 224 and attached cylindrical guide 225 fit atop washer 220 and are held centrally disposed about the center line of the device by the sliding member 221, 222 into which it is press fit. The cap 224 keeps the bimetallic, snap-action disk 106 centrally disposed therein. Cap 224 and guide 225 has a cylindrical aperture 226 centrally disposed on its upper side to allow a post 228 from the lower side of sliding member 222 to slide freely therein.

Figure 2A:
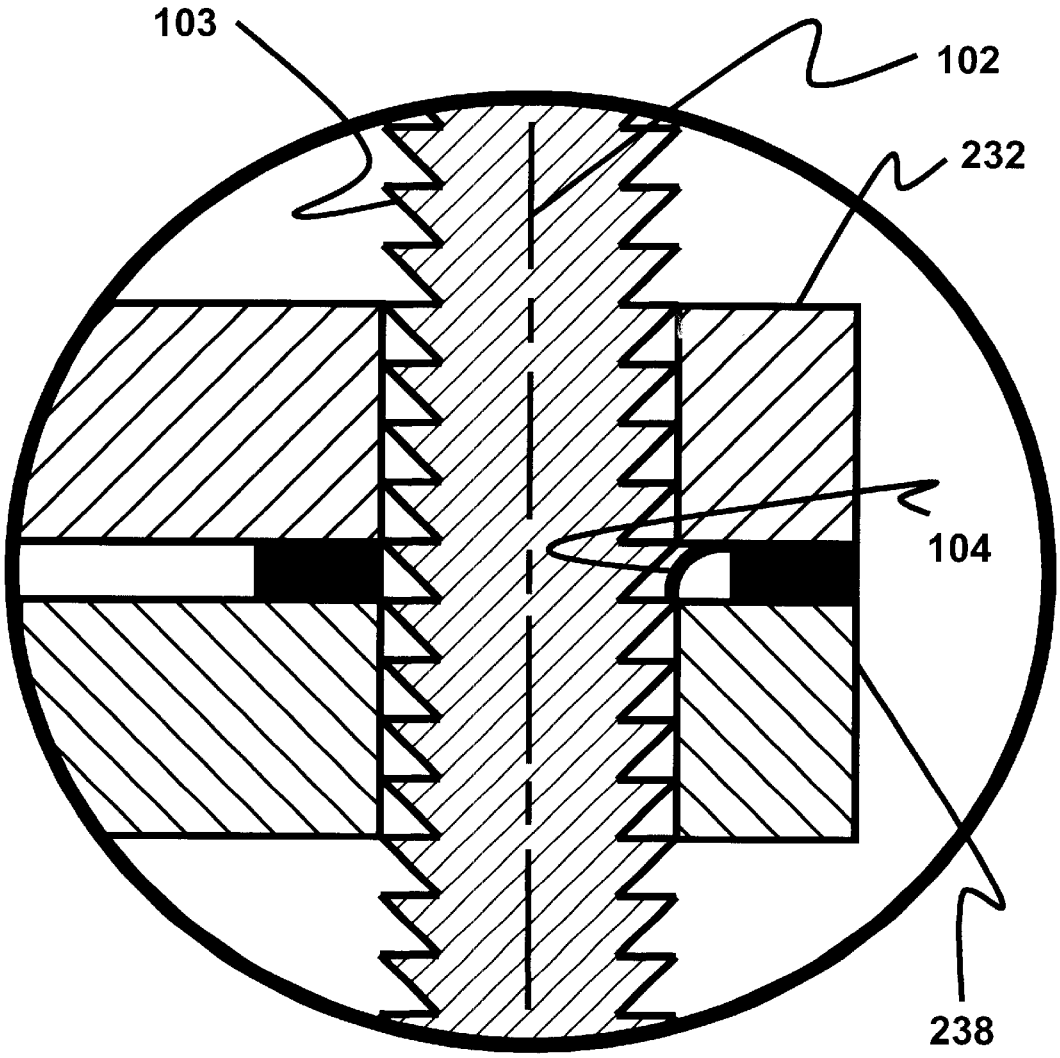
FIG. 2*a* is an enlarged section of the view of the ratchet mechanism shown within circle 2 of FIG. 2.

Sliding members 221, 222, 223 are contained within housing 100 and between end-caps 230, 232. The housing 100 may be connected to the end-caps 230, 232 by many means known to those skilled in the art with a preferred means being trepans 109, 110. A cylindrical central aperture 234 in the bottom end-cap 232 holds the bottom sliding member 221 in position. The cylindrical post 228 of the bottom sliding member 221 is press fit into the aperture 234. Spring 236 is held in the compressed state between the upper tube end-cap 230 and upper most sliding member 223. Bottom disk 238 has a centrally disposed cylindrical aperture 240 therein to allow the bottom post 228 of the bottom sliding member 221 to freely slide. Two threaded fasteners (not shown), 180° diametrically opposed, pass through holes 242, 244, and 246 to ensure that the end caps 230, 232 are secure and compress bottom disk 238 against end cap 232. This compression holds the bottom of the member 102 with first pawl 104. FIG. 2*a* shows an enlarged depiction of circle 2 that more clearly shows the ratcheting mechanism described above.

Referring again to FIG. 2, an upper centrally disposed post 248 of the upper sliding member 223 passes freely through centrally disposed aperture 250 in end cap 230 and is press fit into centrally disposed cylindrical aperture 256 of first upper disk 254. Second upper disk 262 is concentrically placed on top of first upper disk 254. Two threaded fasteners (not shown), 180° diametrically opposed, pass through holes 258, 260 to compress first upper disk 254 against second upper disk 262. This compression holds the upper portion of member 102 with pawl 104*a*.

When the temperature of the above assembly exceeds the transition temperature of the bimetallic, snap-action disks 106, the snap-action disks 106 change shape from 106*a* to 106*b* and allow the posts 228 extending through the apertures 226 in caps 224 to extend toward the sliding member 221, 222, 223 directly beneath the post 228. This allows the spring 236 to uncompress and move the upper and lower set of pawls 104 closer together. When the temperature of the above assembly subsequently cools down to below the transition temperature of the bimetallic, snap-action disks 106, the snap-action disks 106 revert back into their original shape 106*a*. Thus, spring 236 is compressed and moves the upper and lower set of pawls 104 further apart. However, because the first and second pawls 104, 104*a* are unidirectional with respect to member 102, member 102 is moved rather than returning to its original position. This repetitive action, the moving of the pawls 104, 104*a* closer and further apart from each other, will result in the above-described assembly moving up the serrations 103 of the member 102.

Finally, the invention comprises a method for rendering safe land mines using the present invention described above by placing the invention within the land mine so that movement of the member prevents the land mine from firing.

What is described are specific examples of many possible variations on the same invention and are not intended in a limiting sense. The claimed invention can be practiced using other variations not specifically described above.

What is claimed is:

1. A mechanical, temperature activated timer, comprising:

a housing;

at least one member, moveably attached to the housing, having a plurality of serrations arranged unidirectionally along an outside of the member;

at least two pawls that cooperate with the serrations to allow movement of the member in one direction; and, at least one bimetallic, snap-action disc within the housing, having a first shape below a transition temperature and a second shape above the transition temperature, wherein transition from the first shape to the second shape causes a snap-action of the disc, moving the member a distance of one serration.

2. The mechanical, temperature activated timer of claim 1, wherein the bimetallic, snap-action disk comprises an aperture.

3. The mechanical, temperature activated timer of claim 2, wherein a pawl comprises a location proximate to the aperture.

4. The mechanical, temperature activated timer of claim 3, wherein the member moves through the aperture, a distance of one serration, during snap-action of the bimetallic, snap-action disk.

5. The mechanical, temperature activated timer of claim 4, further comprising:

an actuation member, attached to an end of the member, wherein the actuation member provides actuation after the member moves a specified distance.

6. The mechanical, temperature activated timer of claim 5, further comprising:

a trigger;

a firing pin; and, a space between the trigger and firing pin wherein the actuation member may insert itself after the member moves the specified distance prohibiting the trigger from activating the firing pin.

7. The mechanical, temperature activated timer of claim 1, further comprising:

a sliding member, moveably inserted into the housing and contacting the bimetallic, snap-action disk, wherein transition from the first shape to the second shape causes the sliding member to move a predetermined distance and a transition from the second shape to the first state causes the sliding member to return to an original position, thereby moving the member a distance of one serration.

8. The mechanical, temperature activated timer of claim 7, further comprising:

at least one spring within the housing, contacting the sliding member, wherein the spring comprises a compressed state when the bimetallic, snap-action disk comprises the first shape and the spring comprises an uncompressed state when the bimetallic, snap-action disk comprises the second shape.

9. The mechanical, temperature activated timer of claim 8, further comprising:

a plurality of bimetallic, snap-action disks, each having a corresponding sliding member, placed in a series within the housing, wherein the simultaneous transition from the first shape to the second shape of the plurality of disks moves the sliding members with a distance greater than a distance created by one disk.

10. The mechanical, temperature activated timer of claim 9, further comprising:

upper and lower disks, each having a pawl attached therein, the upper disk attached to an upper most sliding member in the series and the member, the lower disk attached to a lower most sliding member in the series and the member, wherein movement of the sliding members causes movement of the upper and lower disks, and, thereby, moves the member a distance of one serration.

* * * * *